US007325987B2

(12) United States Patent
Peeters

(10) Patent No.: US 7,325,987 B2
(45) Date of Patent: Feb. 5, 2008

(54) PRINTING METHOD USING QUILL-JET

(75) Inventor: Eric Peeters, Fremont, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 108 days.

(21) Appl. No.: 11/012,612

(22) Filed: Dec. 14, 2004

(65) Prior Publication Data

US 2006/0125900 A1 Jun. 15, 2006

(51) Int. Cl.
*B41J 2/49* (2006.01)

(52) U.S. Cl. ..... 400/120.16; 400/124.29; 101/93.04; 101/93.05

(58) Field of Classification Search ..... 400/124.29
See application file for complete search history.

(56) References Cited

U.S. PATENT DOCUMENTS

| | | | | |
|---|---|---|---|---|
| 3,624,661 | A | 11/1971 | Shebanow et al. | |
| 4,118,610 | A * | 10/1978 | Purssell et al. | 200/407 |
| 4,162,502 | A * | 7/1979 | Cielo et al. | 347/55 |
| 4,409,603 | A | 10/1983 | Goffe | |
| 4,969,759 | A * | 11/1990 | Suzuki et al. | 400/124.1 |
| 5,156,473 | A | 10/1992 | Suzuki et al. | |
| 5,164,740 | A * | 11/1992 | Ivri | 347/54 |
| 5,237,346 | A | 8/1993 | Da Costa et al. | |
| 5,613,861 | A | 3/1997 | Smith et al. | |
| 5,812,159 | A | 9/1998 | Anagnostopoulous et al. | |
| 5,821,962 | A | 10/1998 | Kudo et al. | |
| 5,889,541 | A | 3/1999 | Bobrow et al. | |
| 5,909,230 | A * | 6/1999 | Choi et al. | 347/54 |
| 6,007,630 | A | 12/1999 | Pletcher et al. | |
| 6,074,688 | A | 6/2000 | Pletcher et al. | |
| 6,176,629 | B1 | 1/2001 | Suzuki et al. | |
| 6,183,055 | B1 * | 2/2001 | Kanematsu et al. | 347/9 |
| 6,228,668 | B1 | 5/2001 | Silverbrook | |
| 6,290,510 | B1 | 9/2001 | Fork et al. | |
| 6,338,547 | B1 | 1/2002 | Silverbrook | |
| 6,362,845 | B1 | 3/2002 | Genovese | |
| 6,459,855 | B1 * | 10/2002 | Kosaka et al. | 396/177 |
| 6,473,107 | B2 | 10/2002 | Koga et al. | |
| 6,515,692 | B2 | 2/2003 | Koga et al. | |
| 6,518,990 | B2 | 2/2003 | Koga et al. | |

(Continued)

FOREIGN PATENT DOCUMENTS

| | | |
|---|---|---|
| DE | 10030872 | 2/2001 |

(Continued)

OTHER PUBLICATIONS

Machine translation of JP 09300705 to Ikeda from Japanese Patent Office website.*

(Continued)

*Primary Examiner*—Daniel J. Colilla
(74) *Attorney, Agent, or Firm*—Kent Chen

(57) ABSTRACT

A system for depositing a material is described. The system uses at least one cantilever, and more typically a plurality of cantilever to transfer small amounts of material from a source of material to a substrate surface. One application for the system is a printing system in which the material is an ink and the substrate is a sheet of paper. By repeating this process, the cantilever places many units of ink to form the pixels in an image.

24 Claims, 5 Drawing Sheets

U.S. PATENT DOCUMENTS

| | | | | |
|---|---|---|---|---|
| 6,618,065 | B2 | 9/2003 | Koga et al. | |
| 6,646,663 | B2 | 11/2003 | Kamoshida et al. | |
| 6,648,470 | B2 * | 11/2003 | Korem | 347/106 |
| 6,650,349 | B2 | 11/2003 | Koga et al. | |
| 6,661,442 | B2 | 12/2003 | Koga et al. | |
| 6,669,334 | B1 | 12/2003 | Silverbrook | |
| 6,750,891 | B2 | 6/2004 | Kamoshida et al. | |
| 6,933,165 | B2 | 8/2005 | Musolf et al. | |
| 2002/0142035 | A1 | 10/2002 | Abrams | |
| 2003/0016277 | A1 | 1/2003 | Hawkens et al. | |
| 2003/0022470 | A1 | 1/2003 | Liu et al. | |
| 2003/0117478 | A1 | 6/2003 | Koga et al. | |
| 2003/0119220 | A1 * | 6/2003 | Mlcak et al. | 438/52 |
| 2003/0202735 | A1 | 10/2003 | Dunec et al. | |
| 2003/0211229 | A1 | 11/2003 | Reeves | |
| 2005/0088468 | A1 * | 4/2005 | Clark | 347/11 |
| 2006/0125900 | A1 | 6/2006 | Peeters | |

FOREIGN PATENT DOCUMENTS

| | | | |
|---|---|---|---|
| DE | 10044908 | | 4/2001 |
| DE | 10030163 | | 1/2002 |
| DE | 10030164 | | 1/2002 |
| DE | 10030165 | | 1/2002 |
| DE | 10030166 | | 1/2002 |
| DE | 10030171 | | 1/2002 |
| DE | 10030178 | | 1/2002 |
| DE | 10030180 | | 1/2002 |
| DE | 10124587 | | 1/2002 |
| DE | 10124588 | | 1/2002 |
| DE | 10124589 | | 1/2002 |
| JP | 60049955 | | 3/1985 |
| JP | 60145860 | A * | 8/1985 |
| JP | 61246066 | | 11/1986 |
| JP | 09300705 | A * | 11/1997 |
| WO | WO 2004/044552 | A2 | 5/2004 |

OTHER PUBLICATIONS

Bartscher, G., Cormier, S. O., Lyness, R., Schein, L. B.: Comparison Of The Electric Field Of Electrophotography And Contact Electrography, Journal Of Electrostatics vol. 53, www.elsevier.com/locate/elstat, Apr. 23, 2001, pp. 295-310.

* cited by examiner

PRINTING METHOD USING QUILL-JET

CROSS-REFERENCE TO RELATED APPLICATIONS

Reference is made to the following commonly assigned, copending patent application, U.S. patent application Ser. No. 11/013,058, filed Dec. 14, 2004 entitled A Quill-Jet Printer. The disclosure of this patent application is hereby incorporated by reference in its entirety.

BACKGROUND

Display and electronic advances have dramatically increased the popularity of portable electronic devices. Notebook computers and personal organizers have become common accessories to many mobile professionals as well as students. However, portable printers have not achieved the same degree of popularity.

Several factor deter portable printer development. One factor is that the free flight of ink in traditional jet printing systems result in high directional tolerances. As a result, high image quality inkjet systems use a multi-pass architecture (a traveling printhead). Such multipass systems utilize motors in two directions, one to move the printhead across the width of the paper, and a second to move the paper lengthwise through the printer. The two directions of movement increases system costs, increases the weight of the printing system and also reduces printer system reliability, especially during travel.

A second problem with portable printers is power consumption. Thermal and piezo-electric printers use substantial amounts of power to move the printhead, move the paper and also heat or otherwise jet the ink. High power consumption quickly drains the batteries of portable printing systems.

Traditional printing mechanisms also place strict tolerances on the type of ink that may be used. Failure to use ink of a specific viscosity and purity can quickly jam the nozzles and channels of the ink jet printing system. In addition, special papers that absorb the ink at a predetermined rate are often needed for acceptable performance. These limitations are undesirable in a low cost portable printing system.

Thus an inexpensive, durable and flexible portable printing system is needed.

SUMMARY

A method of printing an image is described. The method includes causing a cantilever tip to move marking material from a source of marking material to a surface to be printed. Each movement of the cantilever from the source of ink to the surface to be printed carries a unit of ink to the surface to be printed, the unit of ink to form at least a portion of a pixel of the image being printed.

DETAILED DESCRIPTION

An improved printing system is described. The system uses at least one cantilever, and more typically an array of cantilevers, to move a material, typically a marking material to print an image. As used herein, the "materials" distributed may be a solid, a powder, a particulate suspended in a liquid or a liquid. Typically, the "material" is a marking material meaning a material that has a different color then the color of the surface to which the material will be affixed. In a typical example, the marking material is a black ink that is to be affixed to a white sheet of paper. The material may also be a pharmaceutical sample that is deposited in a dosage on a product for administering to a patient, such as a pill or capsule. The material may also be a biological sample for use in combinatorial biochemistry. In combinatorial biochemistry, the carefully controlled deposition techniques may be used to place and amplify specific molecules, such as DNA molecules for detection.

For convenience, the specification will describe the system used in printing/marking systems, although it should be understood that the system for controlling the distribution of toner may also easily control the distribution of other products, such as pharmaceutical and biological products. As used herein, image is broadly defined to include, text, characters, pictures, graphics or any other graphic that can be represented by an ink distribution. Each cantilever includes a controllable tip that moves ink from an ink source to a piece of paper, another surface to be printed, or an intermediate substrate.

Figure 1:
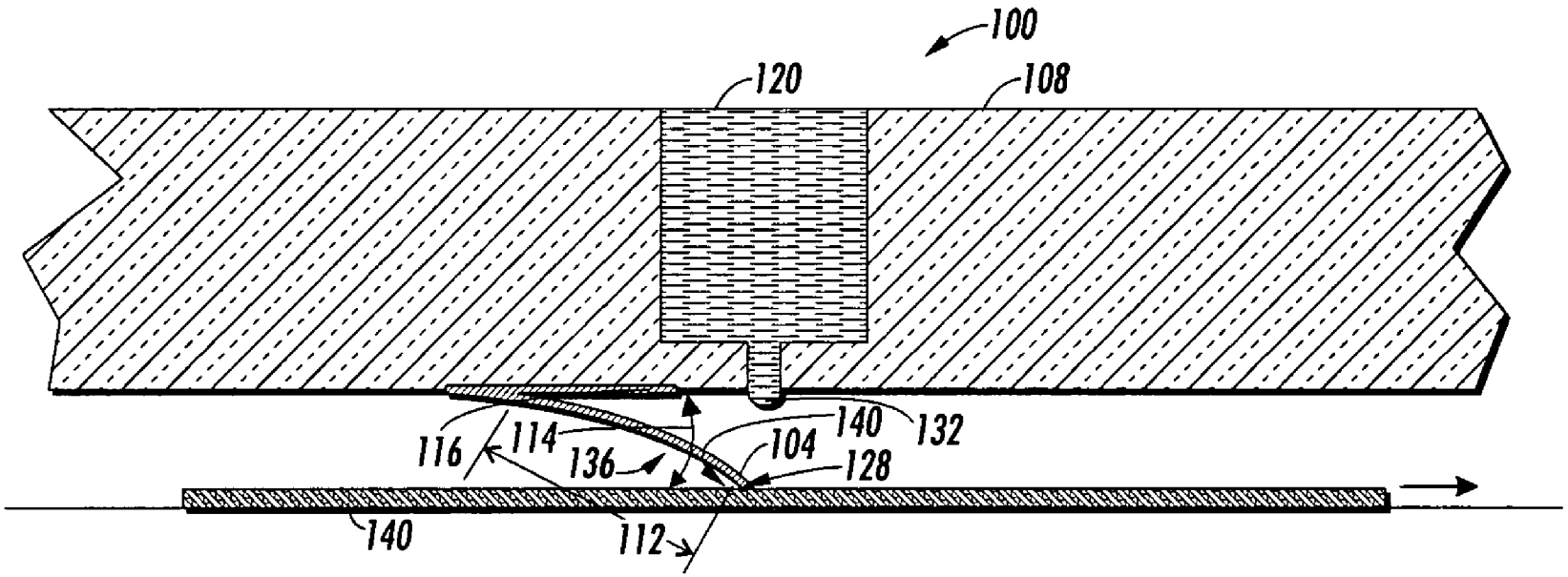
FIG. 1 shows a cross sectional side view of a cantilever printing system.

FIG. 1 shows a cross sectional side view of one embodiment of a printing system 100. In FIG. 1, a cantilever 104 is formed on a substrate 108. Cantilever 104 typically has very small dimensions, less than 2000 microns in length 112. The cantilever flexes to rapidly move through arc path 114. In one embodiment, cantilever 104 is a stressed metal material formed on a printed circuit board (PCB) or glass substrate that includes a tip end and a fixed end.

An actuator 116 moves cantilever 104 between an ink source 120 and a surface 124 to be printed. In one embodiment, Actuator 116 is a low powered piezo-actuated actuator that moves the cantilever. Such piezo-electrics typically consume less power than piezo drivers used to jet fluids through nozzles at high velocities. In an alternate embodiment, Actuator 116 is an electrostatic actuation electrode located underneath or immediately adjacent to cantilever 104. When a power source (not shown) applies an appropriate voltage to the actuation electrode, cantilever 104 lifts upward such that tip 128 contacts ink source 120. In one embodiment, the electrostatic attraction between the actuation electrode and cantilever 104 pulls the cantilever flat against substrate 108. Besides electrostatic and piezo actuation, other methods for moving a cantilever rapidly between small distances may also be used, including heat induced movements, pressure induced movements and movements induced by magnetic fields.

Ink source 120 typically contains a reservoir of ink. As used herein, "ink" is broadly defined to include solids as well as liquids. In one embodiment, surface tension and ink viscosity work together to form an exposed meniscus 132 of ink. The cantilever tip contacts the meniscus to obtain a unit of ink for printing. However, movement of the tip into the ink at high speeds may cause spattering. Thus, in an alternate embodiment, the ink is embedded in a felt or porous medium saturated with ink to avoid spattering.

In the illustrated embodiment, surface tension and cantilever 104 mechanical movement work together to transfer ink from ink source 120 to the cantilever tip. The ink reservoir sometimes prevents the actuation electrode from extending along the entire length of cantilever 104. A particular cantilever geometry assures good contact between the cantilever tip and the ink source. In the illustrated embodiment, the actuator pulls on a curved segment 136. When curved segment 136 is pulled approximately flush against substrate 108, a straight segment 140 assures contact between tip 128 and ink source 120. In an alternate embodiment, the ink source 120 may distribute ink slightly below the plane of substrate 108 to allow for more variations on cantilever geometry.

Once the cantilever tip 128 contacts ink source 120, ink should adhere to ink tip 128. In one embodiment, the cantilever tip is designed to be easily wettable, usually hydrophilic, and the rest of the cantilever as well as other surfaces that come into contact with the ink are designed to be non-wetting, typically hydrophobic. A wettable tip assures that the ink adheres to the tip. The non-wettable cantilever prevents ink wicking along the cantilever. Thus the surface tension causes the ink from the ink source to adhere to ink tip 128. Likewise, surface tension causes the ink to release from the ink tip 128 and adhere to a surface being printed.

Upon actuation, the cantilever moves to an up position. At the ink source, a unit of ink, typically less than a 200 pico-liters (more commonly less than 10 pico-liters) attaches and remains confined to the hydrophilic tip. When a pixel is printed, the actuator releases the cantilever which causes the tip to move the volume of ink to a surface to be printed. Capillary action transfers the ink from the cantilever tip to the surface 140 to be printed.

Using surface tension and mechanical movement instead of more traditional ink deposition methods allows elimination of channels or nozzles in the ink depositing mechanism. Channel and nozzle elimination reduces clogging and allows use of a wider ink variety. To minimize clogging issues, the diameter of meniscus 132 may be made substantially wider than the pixel size being created. Alternately, the meniscus 132 may not be an opening accessed by a single cantilever, instead the opening may be a long 'line' supply for an array of cantilevers. In one embodiment, the opening length approximately matches the width of the array, often 10 to 300 microns with a width small enough such that surface tension prevents ink leakage, typically a width less than 250_microns.

Small channel elimination allows the use of highly viscous inks. Usually inks exceeding a viscosity of 5 centipoise are unsuitable for ink jet printing. Quill jet printing allows the use of highly viscous inks. Such inks offer laser quality output at substantially reduced costs.

As used herein, inks are not limited to liquids. Solid inks may also be used. For example, cantilever tip 128 may transfer a dry toner powder that serves as "ink". In one embodiment, an electric potential difference between ink in the ink source and cantilever tip 128 causes ink to adhere to cantilever tip 128. The electric potential difference may be generated by either electrically charging the cantilever tip or by electrically charging the dry toner powder.

The cantilever tip carries the toner powder from the ink source to the surface to be printed. In one embodiment, electrostatic forces transfer the toner from the cantilever to the surface to be printed. These electrostatic forces may be caused by either charging or discharging the cantilever either the cantilever or the surface to be printed. After deposition, fuser and heat affixes the toner to the surface to be printed. The fixing of toner to paper is similar to the affixing process used in Xerographic systems.

Each cantilever is quite small. For example, cantilever widths of less than 42 micrometers are typically used when depositing dots at 600 dots per inch. In order to achieve 1200 dpi resolution, a cantilever width of less than 24 micrometers is desired (1 inch divided by 1200). The cantilever should also be able to withstand rapid motion. Typical cantilever cycle speeds range between 1000 cycles per second and 10,000 cycles per second although other speeds may also be used.

Figure 2:
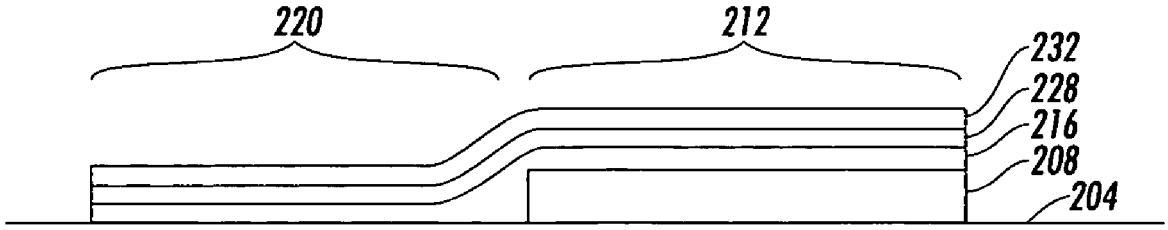
FIG. 2 shows one example of an intermediate structure used to form a stressed metal cantilever

Stressed metal techniques provide one method of forming such cantilevers. FIG. 2 shows a structure used in the process of forming a stressed metal cantilever. Each cantilever may be formed by first depositing a release layer 208 over a substrate 204. Release layer 208 may be formed of an easily etched material such as titanium or silicon oxide.

A release portion 212 of a first stressed metal layer 216 is deposited over the release layer 208 and a fixed portion 220 of first stressed metal layer 216 is deposited directly over substrate 204. Subsequent layers 228, 232 are deposited over first stressed metal layer 216. The stressed metal layers are typically made of a metal such as a Chrome/Molybdenum alloy, or Titanium/Tungsten alloy, or Nickel, or Nickel-Phosphorous alloys, among possible materials.

Each stressed metal layer is deposited at different temperatures and/or pressures. For example, each subsequent layer may be deposited at higher temperature or at a reduced pressure. Reducing pressure produces lower density metals. Thus lower layers such as layer 216 are denser than upper layers such as layer 232.

After metal deposition, an etchant, that etches the release material only, such as HFetches away release layer 208. With the removal of release layer 208, the density differential causes the metal layers to curl or curve upward and outward. The resulting structure forms a cantilever such as cantilever 104 of FIG. 1. A more detailed descriptions for forming such stressed metal structures is described in U.S. Pat. No. 5,613.861 by Don Smith entitled "Photolithographically Patterned Spring Contact" and also by U.S. Pat. No. 6,290,510 by David Fork et al. entitled "Spring Structure with Self-Aligned Release Material", both patents are hereby incorporated by reference in their entireties.

Each cantilever 104 terminates in a tip 128. The shape and form of the tip highly depends on the ink. As previously described, the tip itself is often hydrophilic while the remainder of the cantilever is hydrophobic. Hydrophobic wetting characteristics may be achieved by sealing regions of the cantilever that should be hydrophobic in a hydrophobic coating. Examples of hydrophobic coatings include spin on teflon from DuPont Corporation and plasma deposited fluorocarbons. A photoresist on the cantilever tip prevents the hydrophobic layer from adhering to the tip. After formation of the hydrophobic layer, the photoresist is removed. In an alternate embodiment, the cantilever is formed from a hydrophobic material and a hydrophilic coating coats the tip. However, coating the tip reduces cantilever durability. In particular, the rapid contacts with a printing surface may wear away the hydrophilic coating.

Figure 3:
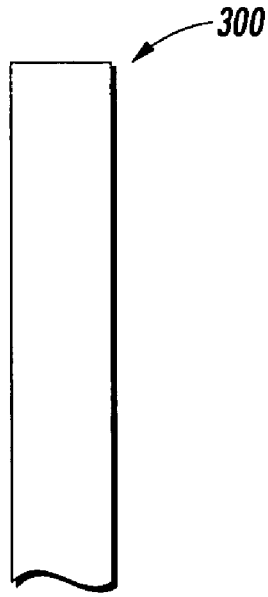
FIG. 3-5 show different cantilever tip shapes that may be used to move ink from an ink reservoir to a surface to be printed.
Figure 4:
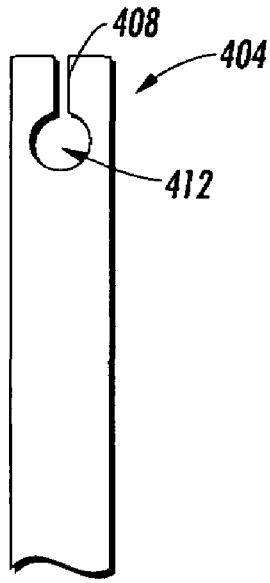
Figure 5:
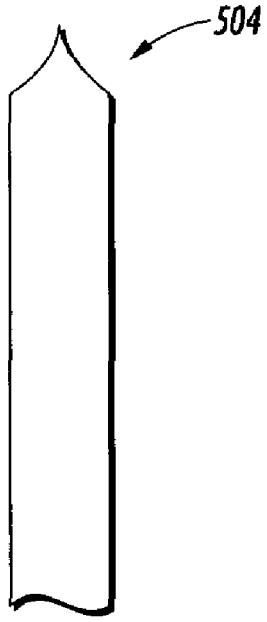

Each cantilever tip shape may also be optimized for moving ink. FIG. 3-5 shows example tip structures. FIG. 3 shows a flat tip 300 that is particularly suitable for moving an ink toner. FIG. 4 shows a slit tip 404 suitable for moving low viscosity inks. Slit 408 provides additional tip surface area that traps liquid ink thus increasing ink volume moved each cantilever cycle. In one embodiment, slit 408 includes a slightly expanded reservoir 412 that further increases ink volume moved each cantilever cycle. FIG. 5 shows a solid point tip 504 suitable for moving small volumes of ink that are to be precisely placed.

Figure 6:
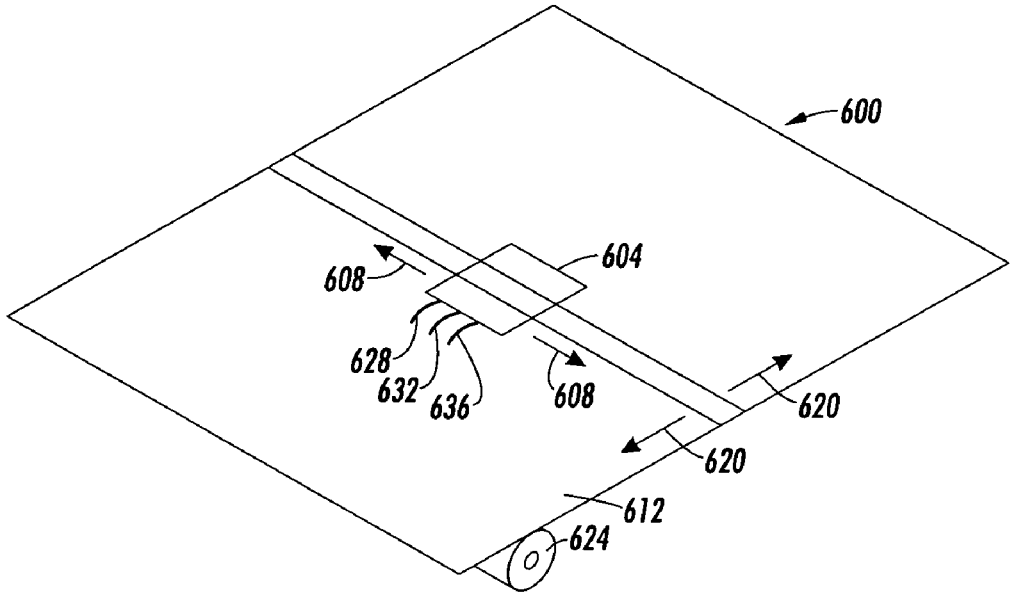
FIG. 6 shows an array of cantilevers installed on a print head for use in a printing system.

In a printing system, each cantilever typically operates in parallel with other cantilevers. FIG. 6 shows a structure 600 that includes a plurality of cantilevers mounted on a carriage head 604. During printing, carriage head 604 moves in a sideward direction 608 across the width of the surface being printed 612. In one embodiment, carriage head 616 also moves along length 620 of the surface being printed. In an alternate embodiment, a paper moving mechanism 624 moves the surface being printed 612 instead of the carriage head.

A processor 628 coordinates the movement of the carriage head 604 and surface 612 being printed. The relative motion of carriage head 604 and surface 612 is arranged such that substantially the entire area to be printed is covered by at least one cantilever in the plurality of cantilevers. The carriage head 604 speed is related to cantilever cycle speed. Thus for example, if the cycle speed of the cantilever is 500 cycles per second, and each pixel deposited by a cantilever is approximately 1 micron, then assuming only one cantilever, the carriage would move by a distance of 500 microns per second in a single direction.

Multiple cantilevers may be used to reduce carriage speed. In a mono-color system, increasing the number of cantilevers by a value x results in a reduction in relative movement between surface 612 and cantilever by the value x. In color systems where cantilevers superimpose pixels on the printing surface to achieve different color shading, adding cantilevers may be used to increase print speed or to increase the number of color choices. Thus color systems and high speed systems typically have more than one cantilever.

FIG. 6 shows a first cantilever 604, a second cantilever 608 and a third cantilever 612 mounted on carriage head 604. In one embodiment of a color printing system, each cantilever controls deposition of a different color ink. For example, in a red-green-blue (RGB) printing system, first cantilever 604 may deposit red ink, second cantilever 608 deposits green ink and third cantilever 612 deposits blue ink. In black and white printing systems, all the cantilevers deposit black ink and the principle advantage of multiple cantilevers is increased print speeds.

Portable printing systems are often subject to mishandling during transport. Thus portable printers should be durable and operable under a range of conditions. Reducing or eliminating carriage head 604 movement increases printer system durability. In particular, fixing the carriage head eliminates motors used to move the carriage. Fixing the carriage head also reduces the probability of the carriage head coming loose during printer transport.

Figure 7:
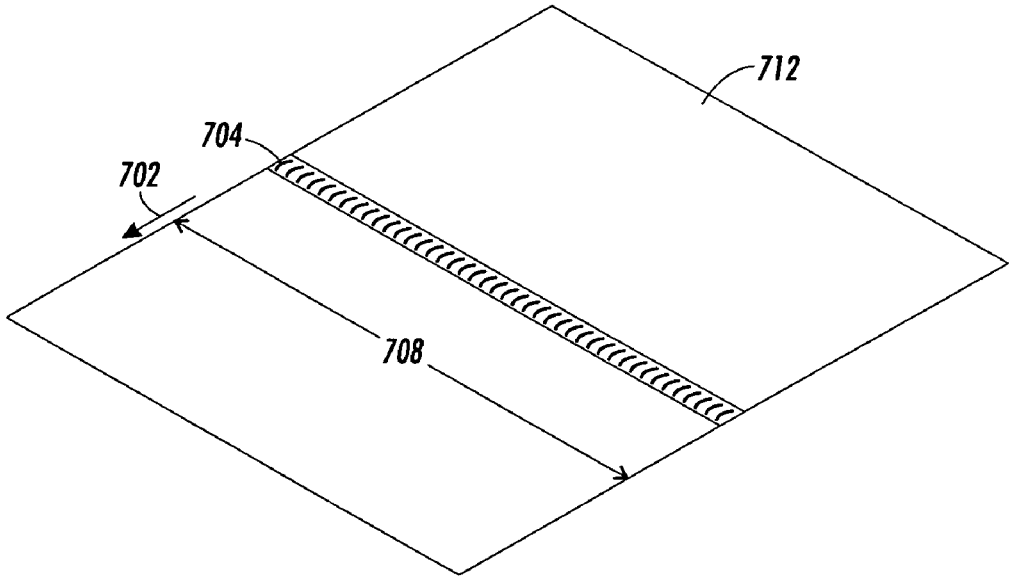
FIG. 7 shows an array of cantilevers spanning the width of an area to be printed for use in a printing system.

Carriage head 604 movement may be eliminated by widening the carriage such that a plurality of cantilevers spans the entire width of the area to be printed. FIG. 7 shows a plurality of cantilevers 704 approximately spanning the width 708 of an area 712 to be printed. The number of cantilevers used depends on both the width of the area being printed and the desired resolution. For example, when printing an 8.5 inch wide paper at a 300 dots per inch resolution, the spanning carriage would have approximately 2550 cantilevers (8.5 inches×300 dots per inch). Each cantilever would deposit approximately one "dot" or one pixel. Higher print resolutions (e.g. 600 dots per inch) would result in correspondingly higher cantilever densities. Dedicated small printers, for example receipt printers, would result in fewer cantilevers needed to span the paper width.

Although FIG. 7 illustrates a plurality of cantilevers spanning the width of the surface to be printed, a plurality of cantilevers may also be distributed along the length of the surface to be printed. Such an array may be used to increase the print speed of the print system. In the embodiment shown in FIG. 7, the printing surface 716 is advanced along direction 702 at a rate equal to the cycle per second of the cantilever divided by the desired resolution. Thus, a 900 cycle per second cantilever movement divided by a resolution of 300 dots per inch would result in a paper speed of approximately 3 inches per second. Increasing the number of cantilevers along the paper length proportionally increases the paper speed and thus proportionately reduces the print time. As will be appreciated by those of skill in the art, various other staggered arrangements of cantilevers along the length and width of the surface to be printed may be used.

In the embodiment of FIG. 6 and FIG. 7, an addressing system independently addresses each cantilever. When electrodes individually actuate each cantilever, electrostatic cross talk can interfere with the addressing of adjacent cantilevers. One way to reduce the effects of the cross talk is to operate the cantilevers in a normally up mode instead of a normally down mode. In a normally up mode, the non-printing cantilevers normally press up against the actuator electrode instead of down against the surface to be printed.

Normally up modes reduce the voltage differentials between adjacent electrodes. These voltage reductions minimize the number of expensive high voltage driver chips in the printing system. The lower voltage differentials also reduce cross talk between adjacent cantilevers. In a normally up mode embodiment, high voltage drive electronics apply a direct current (DC) bias to maintain the cantilevers in the up position. The DC bias takes advantage of the substantial hysteresis typical in electrostatic actuation cantilevers to minimize voltage fluctuations applied to the electrodes.

Figure 8:
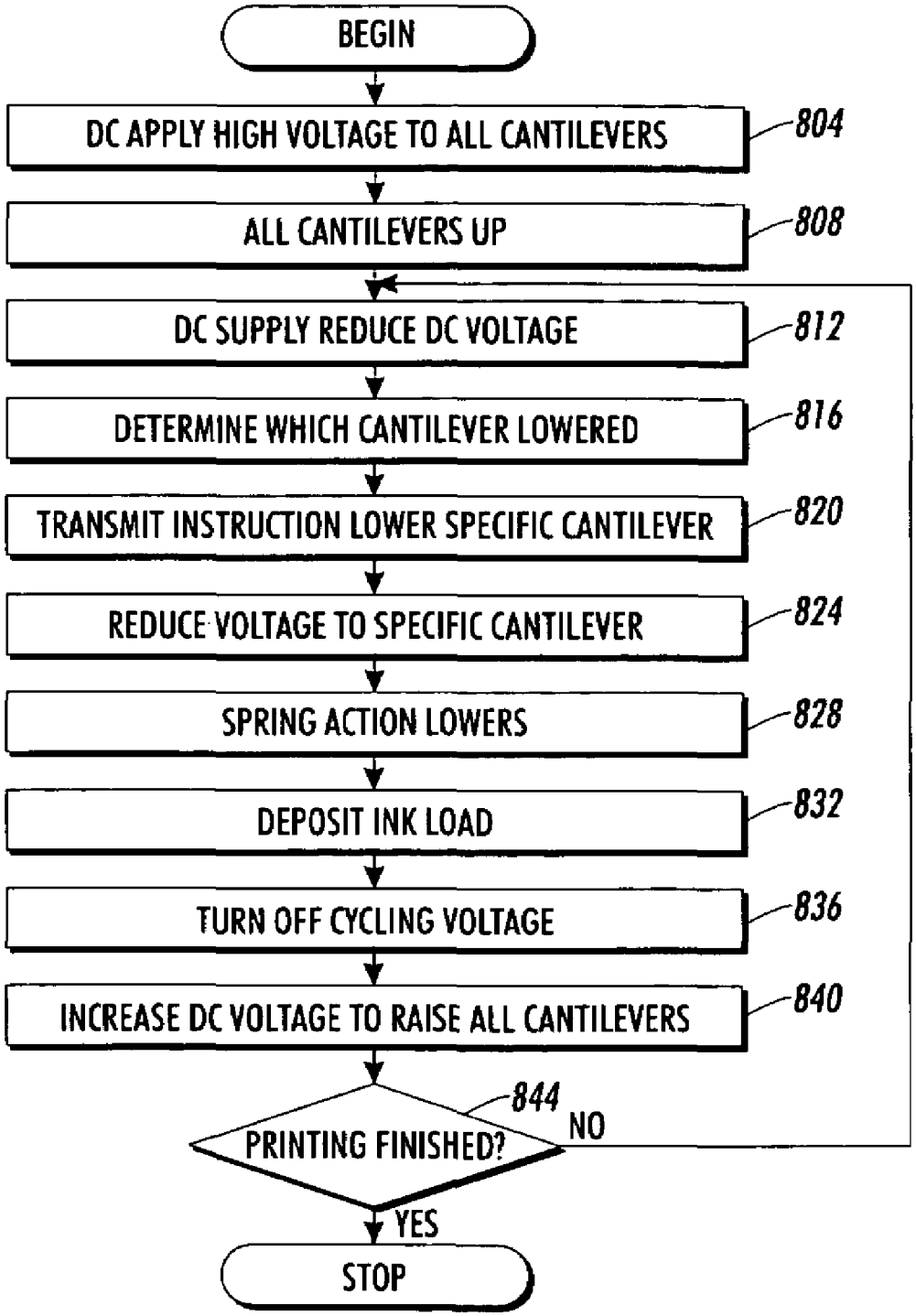
FIG. 8 is a flow chart describing one method of applying power to an electrostatic actuator in the printing systems of FIG. 6 and FIG. 7.

FIG. 8 is a flow chart that shows one example of a voltage sequence applied to a controlling electrode to control a plurality of cantilevers. In block 804, a DC power source 626 of FIG. 6 applies a high voltage to all cantilevers. The high voltage raises all cantilevers to an upward position as described in block 808. The upward position keeps the cantilevers away from the printing surface 628. While in the upward position, the tip of each cantilever accumulates ink from a corresponding ink source.

In block 812, the DC output from the DC power source 626 is slightly reduced. The reduced DC voltage is sufficient to maintain the cantilevers in the up position but insufficient to raise a downward positioned cantilever.

When printing, a processor determines in block 816 which cantilevers to lower. Each lowered cantilever results in a corresponding printed pixel. In a two color system (typically black and white) the determination of whether to lower a cantilever depends merely on whether a drop of ink should be placed in a particular location. In a color system, the determination of whether a cantilever should be lowered also depends on which cantilever corresponds to which ink source and the ink color in each ink source.

In block, 820, processor 634 transmits instructions on which cantilever to lower to a control circuit. In block 824, the control circuit reduces the actuator voltage to cantilevers that should be lowered. Spring action or other stresses in the cantilever lowers the corresponding cantilevers in block 828. In the described embodiment, the lower voltage "allows" spring action to lower the cantilever; the voltage itself does not lower the cantilever.

In block 832, each lowered cantilever deposits a corresponding "load" or unit of ink onto the surface to be printed. This ink deposition corresponds to printing of a pixel in the image. Thus a plurality of pixels deposited by all the cantilevers over time forms the printed image. As used herein, "image" is broadly defined to include, but not limited, to any marking including any character, text, graphic or pictorial representation.

After printing pixels, the cycling voltage source is set to a neutral position in block 836. In one embodiment, "neutral" may be an off state. The voltage output of the DC power source increases in block 840 to raise all previously lowered cantilevers. In block 844, a processor determines whether the printing of the image is complete. Printing of the image is typically complete when all pixels corresponding to the image have been deposited. If printing of the image has not been completed, the process is repeated starting from block 816. If all printing is completed, the printing process terminates in block 848.

Although flow chart 800 describes one method of controlling the cantilevers, other methods may be applied. For example, one minor change uses a second power supply to maintain the up cantilevers in an up position and to lower the DC power source voltage. Thus only cantilevers not coupled to the second power supply are lowered.

Normally down state printing systems are also possible. In a normally down state printing system, cantilevers that are not depositing ink during a cycle remain in contact with the surface being printed. However printing the down state cantilevers do not print because they do not have ink. However, as previously described, such down state systems require careful designs because cross talk can adversely affect system performance.

Although the preceding description describes the distribution and affixing of marking materials, usually a liquid ink, other materials may be distributed and affixed. For example, powders and toners may also be distributed. Non-marking materials may also be "printed". For example, the described system and techniques may be used to control distribution of a biological sample or a pharmaceutical product. In a biological sample embodiment, the cantilever moves molecules of a biological sample onto a substrate for further testing and analysis. In one embodiment, the cantilevers are used to deposit biological samples in a microarray for testing. A typical substrate may have wells, such as electrodeposition wells or other containment structures that confine the sample for analysis using chemical and/or electrochemical techniques. The substrate may also be a silicon substrate. Often, the deposited molecules include DNA samples which will be amplified and analyzed using the combinatorial techniques. A more detailed description of microarray testing of biological samples and example of how such testing may be used is described in an article by Gwynne P. and Page G. entitled "Microarray Analysis: The Next Revolution in Molecular Biology", Science, Aug. 6, 1999.

In a pharmaceutical embodiment, the cantilever moves pharmaceutical product from a source of pharmaceutical product to a deposition surface. Subdivisions of the surface are deposited into containers such as pills or capsules. Because the quantity of pharmaceutical product can be very precisely controlled, the quantity in each subdivision can be carefully controlled to match a dosage that is adequate to treat a particular medical condition.

The preceding description includes a number of details that are included to facilitate understanding of various techniques and serve as example implementations of the invention. However, such details should not be used to limit the invention. For example, duty cycles, tip geometries, cantilever fabrication techniques and voltage sequences have been described. These details are provided by way of example, and should not be used to limit the invention. Instead, the invention should only be limited to the claims as originally presented and as they may be amended, including variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of printing comprising:

bringing a tip end of a cantilever in contact with a source of marking material, the cantilever including an internal stress gradient that maintains the cantilever in a curved state in the absence of an applied force;

adjusting an actuator resulting in movement of the tip end of the cantilever from the source of marking material to a surface to be printed, the tip end transferring a unit of marking material from the source of marking material to the surface to be printed.

2. The method of claim 1 wherein the operation of adjusting the actuator includes changing decreasing a voltage on an electrode, the absence of a voltage to result in a curved cantilever including a tip that contacts the surface to be panted.

3. The method of claim 1 wherein the cantilever is a stressed metal cantilever, the stressed metal deposited to form the internal stress gradient.

4. The method of claim 1 further comprising: adjusting the voltage on an electrode that serves as the actuator to move the tip end of the cantilever from the surface to be printed back to the source of marking material.

5. The method of claim 1 wherein the voltage on an electrode that serves as the actuator adjusts an electric field to allow movement of the tip end of the cantilever.

6. The method of claim 1 wherein the actuator changes a temperature that causes the movement of the cantilever.

7. The method of claim 1 wherein the cantilever is a bimetal with an internal stress gradient.

8. The method of claim 1 wherein the actuator includes a piezo-electric that actuates the cantilever.

9. The method of claim 1 wherein a magnetic field is used to actuate the cantilever.

10. The method of claim 2 further comprising:

waiting until the unit of marking material is transferred from the tip of the cantilever to the surface to be printed; and, increasing a voltage on an electrode that serves as an actuator to move the tip of the cantilever from the surface to be printed to the marking material source.

11. The method of claim 1 further comprising:

waiting until the unit of marking material is transferred from the tip of the cantilever to the surface to be printed, the unit of marking material to form a an area of an image;

adjusting the voltage to move the tip of the cantilever from the surface to be printed to the marking material source; and, moving the surface to be printed to a position to receive a second unit of marking material from the tip of the cantilever, the second unit of marking material to form a second area of the image.

12. The method of claim 1 wherein the marking material is a liquid, the liquid to adhere to a wetting tip of the cantilever, the remainder of the cantilever to be substantially nonwetting to confine the liquid marking material.

13. The method of claim 12 wherein the unit of liquid marking material is less than 10 picoliters.

14. A method of printing a plurality of pixels to form an image, the method comprising:

moving a first tip of a first cantilever between a source of ink and a surface to be printed to print a first set of pixels in the plurality of pixels, the first cantilever including an internal stress gradient that maintains the first cantilever in a curved state in the absence of an applied force;

moving a second tip of a second cantilever between a second source of ink and the surface to be printed to print a second set of pixels in the plurality of pixels, the second cantilever including an internal stress gradient that maintains the second cantilever 1n a curved state in the absence of an applied force; and, moving a third tip of a third cantilever between a third source of ink and the surface to be printed to print a third set of pixels in the plurality of pixels, the third cantilever including an internal stress gradient that maintains the third cantilever in a curved state in the absence of an applied force.

15. The method of claim 14 wherein the first source of ink is a first material, the second source of ink is a second material different from the first material, and the third source of ink is a third material, the third material of ink different from both the first material and the second material.

16. The method of claim 15 wherein the first material, the second material and the third material are all different colors.

17. The method of claim 14 wherein the moving of the first cantilever is controlled by an electric field generated by an electrode.

18. The method of claim 14 wherein the moving of the first cantilever is controlled by a piezo-electric.

19. The method of claim 14 wherein the pixels are placed in close proximity such that the density of pixels exceeds 200 dots per inch.

20. The method of claim 14 wherein the first cantilever, the second cantilever and the third cantilever are formed from stressed metals.

21. The method of claim 14 wherein the first cantilever, the second cantilever and the third cantilever are formed from bi-metals, the movement of the cantilevers controlled by adjusting a temperature.

22. A method of print a plurality of pixels to create an image, the method comprising:

receiving an electronic representation of an image;

transmitting instructions from a processor to release a first tip of a first cantilever Such that an internal stress gradient moves the first tip between a first source of ink and a surface to be printed, the first tip to print a first set of pixels in the plurality of pixels;

transmitting instructions from a processor to release a second tip of a second cantilever such that an internal stress gradient moves the second tip between a Second source of ink and the surface to be printed, the second tip to print a second set of pixels in the plurality of pixels; and, transmitting instructions from a processor to release a third tip of a third cantilever such that an internal stress gradient moves the third tip between a third source of ink and a surface to be printed, the third tip to print a third set of pixels in the plurality of pixels.

23. The method of claim 22 wherein the first source of ink is a first color, the second source of ink is a second color different from the first color, and the third source of ink is a third color, the third color of ink different from both the first color and the second color.

24. A method of depositing a material comprising the operations of:

moving a first tip of a first cantilever between a source of material wherein the material is a biological compound and a deposition surface wherein the deposition surface is the inside of a capsule to be ingested, the first tip to move a quantity of material less than 100 picoliters from the source of material to the deposition surface; and, moving a second tip of a second cantilever between the source of material and the deposition surface the second tip to move a second quantity of material less than 100 picoliters from the source of material to the deposition surface.

* * * * *